United States Patent [19]

Gerry

[11] 4,161,937

[45] Jul. 24, 1979

[54] IGNITER WITH MAGNETIC ACTIVATION

[76] Inventor: Martin E. Gerry, 13452 Winthrope St., Santa Ana, Calif. 92705

[21] Appl. No.: 756,547

[22] Filed: Jan. 3, 1977

Related U.S. Application Data

[63] Continuation-in-part of Ser. No. 707,208, Jul. 21, 1976, abandoned.

[51] Int. Cl.[2] ..... F02P 1/00

[52] U.S. Cl. ..... 123/169 EL; 123/169 R; 313/153; 313/155

[58] Field of Search ..... 123/148 E, 169, 148 AC, 123/148 A; 313/153, 154, 155, 156, 157

[56] References Cited

U.S. PATENT DOCUMENTS

| | | | |
|---|---|---|---|
| 1,244,844 | 10/1917 | Dodds | 123/148 A |
| 1,290,121 | 1/1919 | Donat | 313/155 |
| 1,482,422 | 2/1924 | Workman | 313/153 |
| 1,518,462 | 12/1924 | Smith | 313/153 |
| 1,597,963 | 8/1926 | Gantner | 313/155 |
| 2,208,030 | 7/1940 | Holmes | 313/157 |
| 3,110,294 | 12/1962 | Nyman | 123/119 E |
| 3,265,931 | 8/1966 | Gerry | 123/148 AC |
| 3,408,536 | 10/1968 | Tibbs | 123/148 E |
| 3,830,621 | 8/1974 | Miller | 123/119 E |
| 3,878,469 | 4/1975 | Bolasny | 123/119 E |
| 3,897,767 | 8/1975 | Gordon | 123/148 E |

*Primary Examiner*—Ronald B. Cox

[57] ABSTRACT

A method and apparatus for delivering high electrical energy levels by means of an igniter to an air-fuel mixture within an engine, is disclosed. The method and apparatus utilizes any of a variety of igniters of simple construction in an ignition system powered by an non-DC source to obtain extremely high current excursion peaks and extremely high alternating voltage levels feeding the igniters sequentially with the result of obtaining high intensity and high velocity plasma arcs of ionized matter. Such ionized matter may be subjected to a magnetic field integral with each igniter to substantially increase the energy level of the plasma, visually noting the increase in plasma intensity with audible increase in plasma velocity in an experimental set-up. The plasma generates ozone from the air component of the mixture or in the experimental set-up from the air surrounding the igniter, which ozone materially increases the fuel combustion rate and consequently improves engine operating efficiency.

5 Claims, 23 Drawing Figures

CUSP ARC EFFECT
Modified Champion Type N-13Y Igniter
Approximate Length of Each Arc Element Between
Axial Electrode and Base = 0.125 inches (3.175 millimeters)

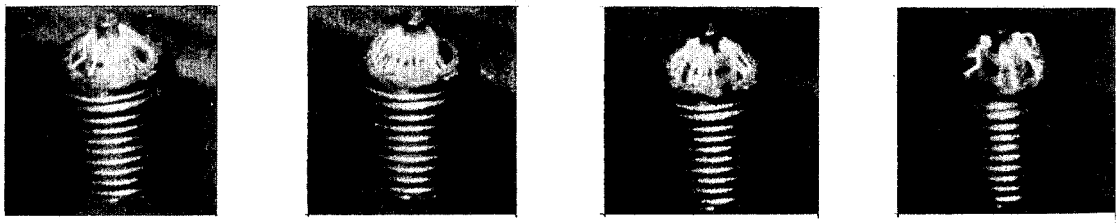

501 502 503 504

FIG. 19

CUSP ARC EFFECT
Modified Champion Type J-12Y Igniter
Approximate Length of Each Arc Element Between
Axial Electrode and Base = 0.250 inches (6.35 millimeters)

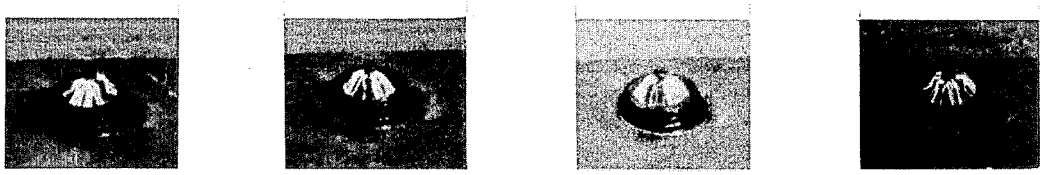

511 512 513 514

FIG. 20

TUBULAR CURTAIN ARC EFFECT
Modified Champion Type N-9Y Igniter
Approximate Length of Each Arc Element Between
Axial Electrode Plate and Base = 0.500 inches (12.7 millimeters)

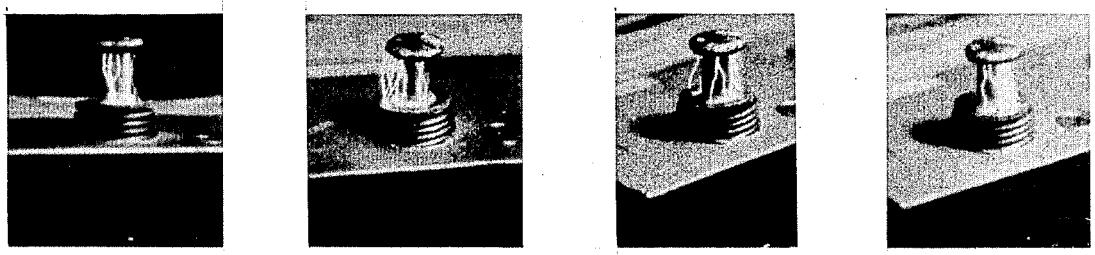

521 522 523 524

FIG. 21

SPOKE-WHEEL ARC EFFECT
Modified AC Type 45S Igniter
Approximate Length of Each Arc Element Between
Axial Electrode and Base = 0.125 inches (3.175 millimeters)

531 532 533 534

LIGHT-BULB, FIREBALL, OR BLOOMING ILLUMINATION
PHENOMENA WITH INCREASE IN IGNITER VOLTS
Modified J-12Y and 45S Igniters
Approximate Distance Between
Axial Electrode and Base = 0.250 inches and 0.125 inches 551 552 553 554
555 556 557 558
559 560 561 562

IGNITER WITH MAGNETIC ACTIVATION

CROSS REFERENCE TO RELATED APPLICATION

This is a continuation-in-part of copending application Ser. No. 707,208 filed July 21, 1976 and now abandoned, incorporated by reference principally for the computations therein and in the file wrapper thereof.

BACKGROUND OF THE INVENTION

This invention is in the field of igniters for hydrocarbon fuel burning engines and more particularly deals with a method using a modified igniter to deliver high energy plasma levels to fire fuel within an engine.

The prior art though having igniters of a variety of types, has not shown how to drive these igniters to deliver high energy, has not found how to utilize such igniters in a manner that would yield a high energy plasma instead of an easily extinguishable spark, and therefore has not been successful in obtaining high engine efficiency by virtue of not being able to burn all the fuel injected therein.

SUMMARY OF THE INVENTION

A method and apparatus for igniting an air-fuel mixture in an engine utilizes any of a variety of igniter configurations with equal results.

At least a portion of the air-fuel mixture is ionized in proximity of the electrodes of the igniters thereby creating a plasma at least in proximity of such electrodes The plasma may be subjected to a magnetic field which field may be created by virtue of the igniter base material being permanently or electromagnetically magnetized, or by permanently or electromagnetically magnetizing the axial electrode of the igniter, or both, with the result of increasing the velocity of the plasma and its intensity between such electrodes to efficiently burn the fuel.

The use of a high magnitude of alternating power applied to each such igniter results in the generation of ozone from the air of the air-fuel mixture which increases the rate of combustion of the fuel since ozone is a very strong oxidizing agent.

The plasma arc generated is preferably in a direction orthogonal to the pressure gradient (vector) of the pressure created within the engine. This has the effect of the arc not being extinguishable by the pressure gradient. Such arc would in commonly available engines therefore be radial between the outer surface of the axial electrode and the inner surface of the base in a spoke-wheel configuration. The end of the axial electrode within the confines of the base may be crimped to provide a roughened or ragged surface which encourages arcing between such raised portions of the ragged surface and the inner periphery of the base.

Therefore, if the spoke-wheel of the arc makes an acute angle with the plane of the firing end of the base by virtue of the axial electrode being raised above the base firing end, the smaller the acute angle the less susceptible the arcs are to the pressure vector or gradient internal the engine. This is true in all cases. But where an igniter has an axial electrode terminating in a disk or dish the arcs will fire between the disk or dish and the base. In such instance, the disk or dish serves to physically shield the arcs from the pressure vector or gradient.

Contrary to conventional ignition systems, a rate effect appears to be present and influencing the arc intensity. As the engine is driven with increasing speed the arc intensity increases with the speed.

Figure 2:
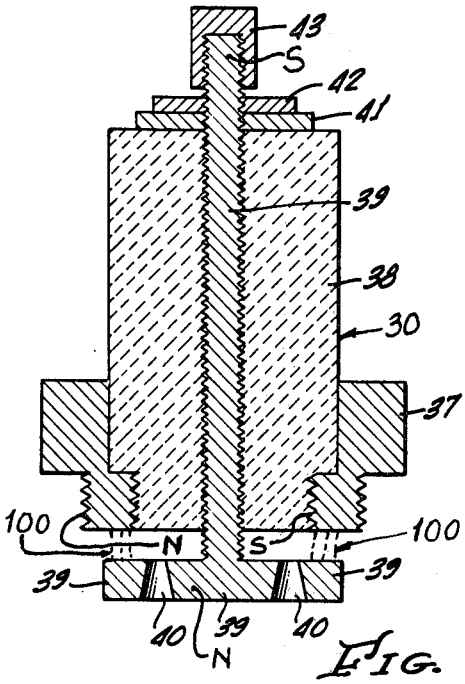
FIG. 2 is a cross-section view taken at plane 2—2 of FIG. 1.
Figure 1:
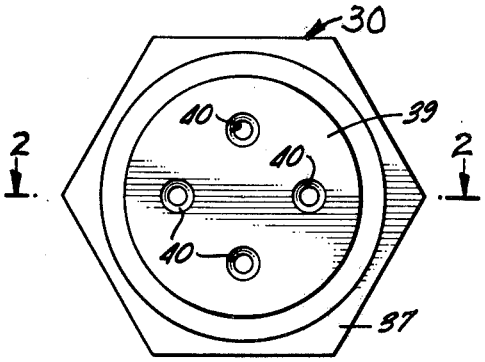
FIG. 1 is a plan view showing principally the metallic base and the disk portion of the axial electrode of the igniter.
Figure 9:
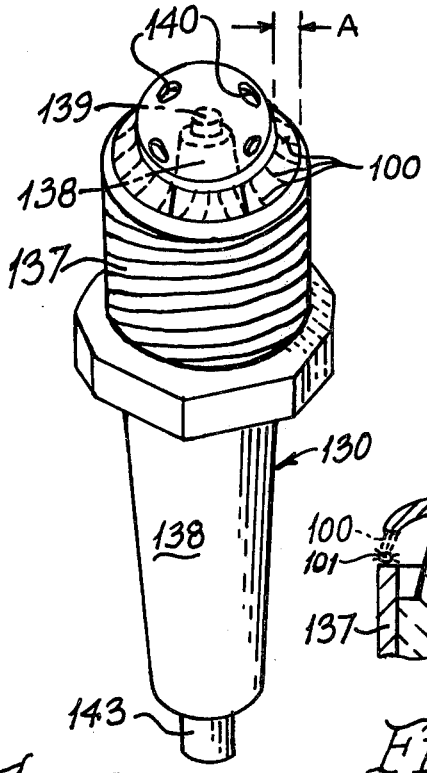

The subsequently numbered figures are addressed chiefly to the laboratory test results as observed, though certain of the configurations of the igniters in above figures were tested also:

FIG. 9 is a perspective view of an igniter similar to the igniter of FIGS. 1–2, except that the member terminating the axial electrode is of dish shape, as compared to the flat disk shape of FIGS. 1–2, showing the arc pattern circumjacent the dish and base peripheries having arc lengths of about 0.250 inches per each arc element.

Figure 10:
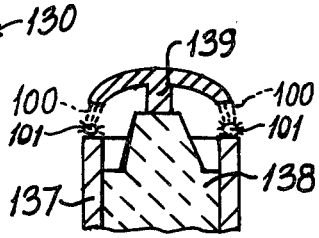

FIG. 10 is a cross-section view of the firing end of the igniter of FIG. 9, at a plane of FIG. 9 which does not show the apertures in the dish, for the purpose of showing the approximate firing locations of the arcs and the bright fireballs of light resulting when the voltage level input to the ignition transformer primary is raised between 10 and 30 percent.

Figure 11:
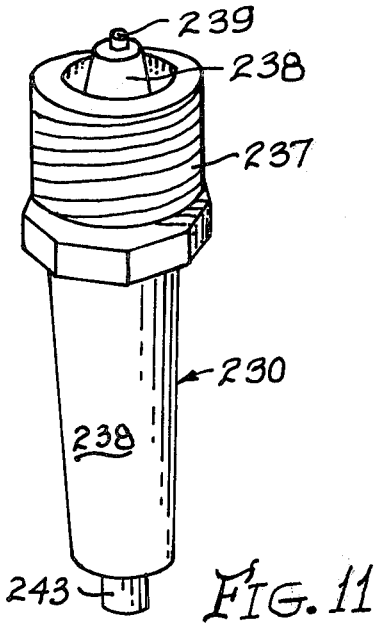

FIG. 11 is a perspective view of a modified commercially available igniter which has the firing end of its axial electrode raised above the firing end of the base so that arcs of about 0.250 inches in length will be made possible.

Figure 12:
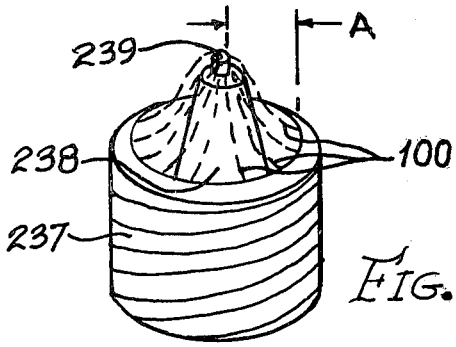

FIG. 12 is a perspective view of the base and firing electrode in accordance with FIG. 11, showing the arc pattern resulting between the end of the axial electrode and the inner base periphery in the form that may be described as a somewhat distorted half of an elipsoid along the major axis of the elipsoid. Notably, this igniter also provides the bright fireballs of light under similar conditions to those described in connection with FIG. 10, above.

Figure 13:
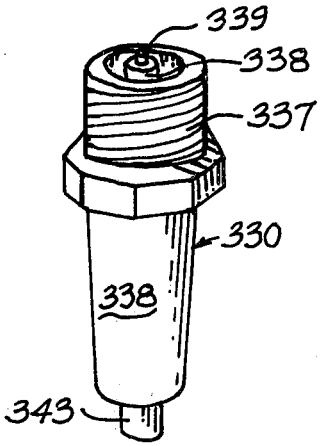

FIG. 13 is a perspective view of a modified commercially available igniter which has the firing end of its axial electrode virtually in line with the firing end of the base so that arcs of about 0.125 inches in length will be possible.

Figure 14:
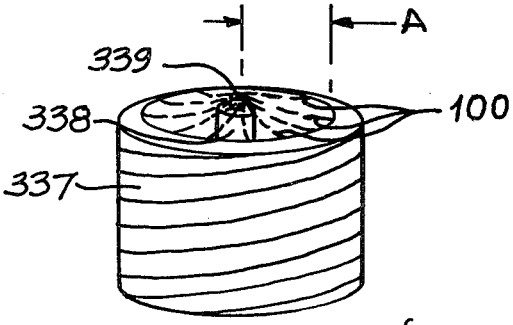

FIG. 14 is a perspective view of the base and firing electrode in accordance with FIG. 13, whowing the arc pattern resulting between the end of the axial electrode and the inner periphery of the base in the form of a generally flat spoke-wheel of arc elements. In this igniter the bright fireballs of light under similar conditions to those described in connection with FIG. 10, above are also possible.

Figure 15:
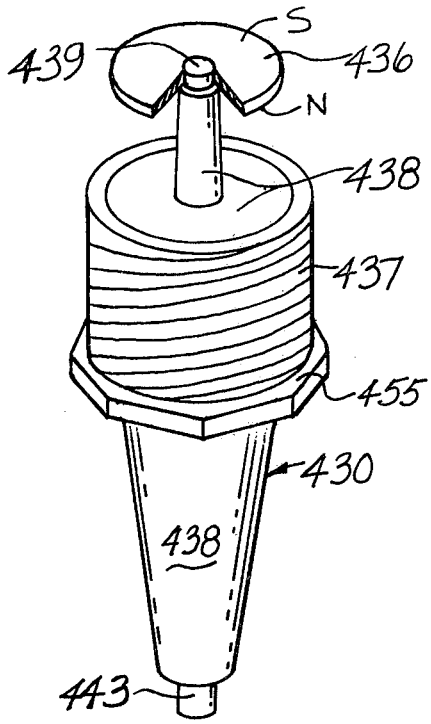

FIG. 15 is a perspective view of a modified conventional igniter, with certain portions thereof not included for illustration purposes, where the modification consisted of decreasing the length of the base so as to provide a greater firing arc path between the base and axial electrode. This figure provides a disk attached to the axial electrode for shielding the arc elements from the pressure vector within the engine.

Figure 16:
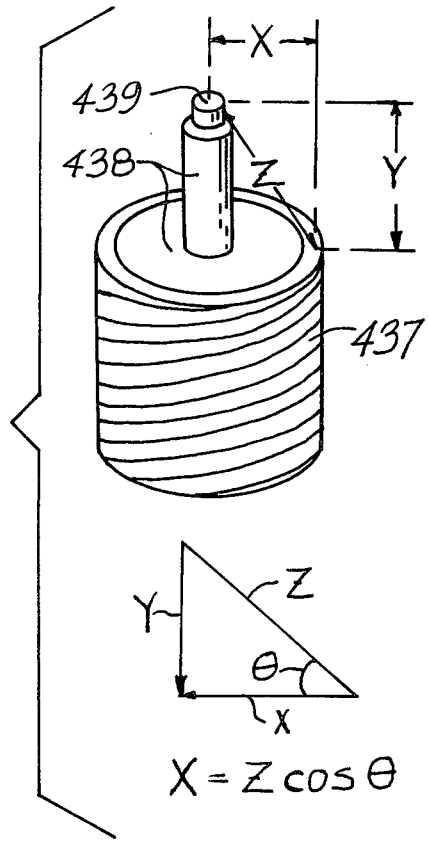

FIG. 16 is a perspective view of part of the igniter of FIG. 15 to illustrate the principal portions of the igniter which fire and the horizontal and vertical components thereof shown in a phasor diagram in said figure.

Figure 17:
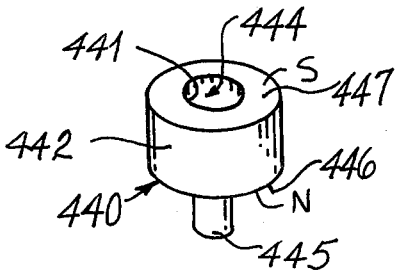

FIG. 17 is a permanently magnetized member, adaptable to FIG. 15. igniter and all other igniters, which provides a magnetic flux through the axial electrode of each igniter to which this member is adapted.

Figure 18:
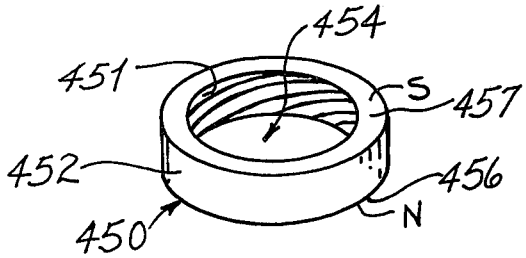

FIG. 18 is a permanently magnetized ring made to adapt to the base of any igniter or to cooperate with such base by magnetic attraction, so as to provide a magnetic field at the firing end of the base of any igniter to which this ring is adapted or cooperates with.

FIG. 19 comprises high speed photographs of the firing end of an igniter having a long shank or base, producing a cusp arc effect.

FIG. 20 comprises high speed photographs, of the firing end of an igniter different from the igniter of FIG. 19, producing a cusp arc effect where the arc elements of the cusp are each longer than the elements of the cusp of FIG. 19.

FIG. 21 comprises high speed photographs, of the firing end of an igniter modified to be different from the igniters of FIGS. 19 and 20, producing a tubular curtain arc effect where the arc elements of the tubular curtain are each longer than the arc elements of the cusps of FIGS. 19 or 20.

Figure 22:
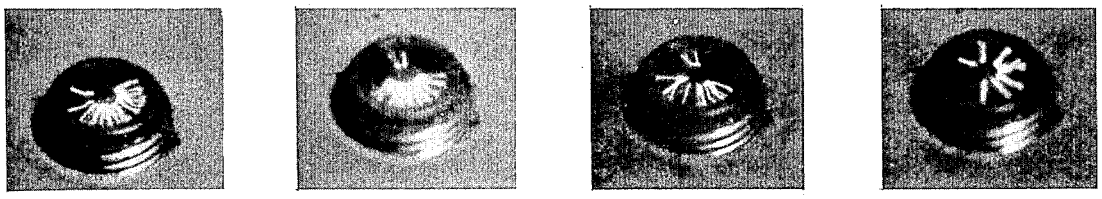

FIG. 22 comprises high speed photographs, of the firing end of an igniter utilizing a lower axial electrode-base profile than the igniters of FIGS. 19–21, producing a spoke-wheel arc effect.

Figure 23:
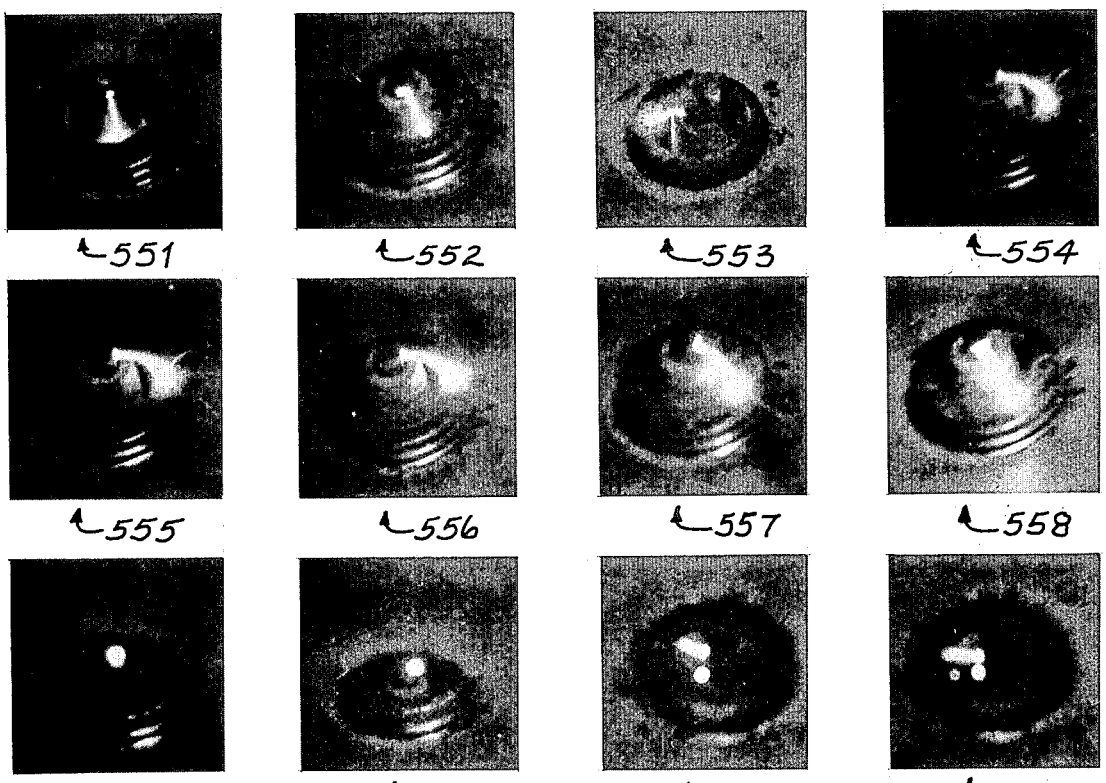

FIG. 23 comprises a series of high speed photographs, of the firing ends of igniters similar to igniter of FIG. 22 but modified, showing light-bulk, fireball, or blooming illumination phenomena with increase in igniter voltage,

DETAILED DESCRIPTION

Referring to FIGS. 1 and 2, an igniter 30 is provided for utilization in an engine to combust the fuel therein.

Igniter 30 comprises base 37 for seating same into the engine. Base 37 is made of magnetizable material so it may be magnetized, as here south S at its inner periphery and north N at its outer periphery to create a magnetic field between outer and inner pheripheries. Magnetization may be permanent in which case the material would be a hard steel, alnico or other materials which are both electrically conductive and magnetize permanently which are well known in the art, or may be electromagnetically magnetized in which case the material would be a softer iron or other like materials with a coil of wire wound about the outer periphery of base 37 and electrically connected to a DC power source in appropriate current flow direction to obtain the desired magnetic polarities.

A generally ceramic insulator is provided at 38 held mechanically or otherwise to the inner surface of the base. Axial member 39, made of similar materials as base 37, is held by and within insulator 38. Member 39 includes an elongated portion and a disk portion facing the base. The disk portion has apertures 40 therein tapered from a smaller diameter at the surface opposite to and facing the base to a larger diameter at its surface away from the base.

The disk portion of member 39, if magnetized, would be magnetic north N whereas the opposite end of member 39 would be magnetic south S, in such instance where both base 37 and member 39 are magnetized so that there would exist a magnetic field between the lower extreme of base 37 and the inner surface of the disk of member 39. The same principles and magnetic materials as discussed for permanent and electromagnetic configurations in connection with base 37 would equally apply to member 39.

It is to be understood that in this invention, magnetization of both base 37 and member 39 are not required, only one of these will suffice to obtain the increased energy levels later discussed. However, the choice as to which of these members are magnetized is one related to economics of fabrication and convenience of utilization. Of course the magnetic polarites shown and discussed could all be reversed with the same end results.

Axial member 39 extending at its upper end from insulator 38 has a washer 41 cooperating with the outer surface of insulator 38 and a nut 42 screwed on the upper threaded portion of member 39 to securely hold member 39 in insulator 38. A metallic cap at 43 is screwed on to the terminal point of member 39 to make connection with an appropriate high voltage ignition wire of an ignition system.

A magnetic field is created between base 37 and disk portion of member 39 in the vicinity of arcs 100 occurring between the base and the surface of the disk portion facing the base.

It is to be understood that in discussing subsequent figures with minimum variations of the structure of FIGS. 1–2, that the same principles as to use of materials and permanent or electromagnetic magnetization will apply, and therefore as such need not be further discussed.

It is also to be understood that in discussing subsequent figures with minor variations of the structure of FIGS. 1–2, that either the axial electrodes or the bases may be magnetized with beneficial results, to be hereinafter discussed in connection with FIG. 8.

Figure 3:
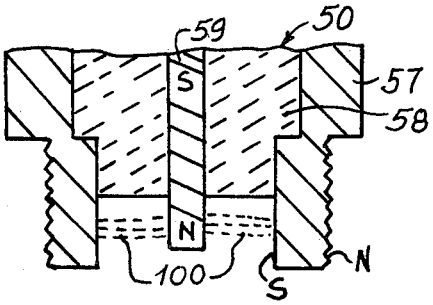
FIG. 3 is a portion cross-section view of the base portion of an igniter having only an axial electrode and a base circumjacent and insulated from the axial electrode.

Referring to FIG. 3, the lower or firing portion of igniter is shown at 50. Igniter 50 has a base 57 and insulator 58, similar to base 37 and insulator 38 of FIGS. 1–2 respectively. Axial member 59 is provided through and along the lengthwise axis of insulator 58 into a chamber formed by the inner wall of base 57 circumjacent the insulator. As in FIGS. 1–2, the upper portion of member 59 is polarized magnetic south S and the lower portion within the chamber is polarized magnetic north N. The inner periphery of base 57 is polarized south S and the outer periphery thereof magnetic north N. A magnetic field is created between base 57 and member 59 in the vicinity of radial arcs 100 occurring between the inner periphery of base 57 and outer periphery of member 59.

Figure 4:
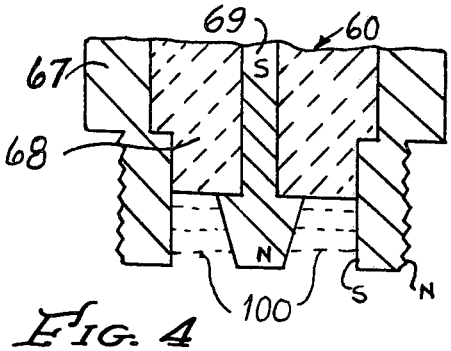
FIG. 4 is a cross-section view of a similar portion of an igniter as in FIG. 3 except the lower end of the axial electrode within the base confines is tapered.

Referring to FIG. 4, the lower or firing portion of igniter is shown at 60. Igniter 60 has a base 67 and insulator 68, similar to base 57 and insulator 58 of FIG. 3 respectively. Axial member 69 is provided through and along the lengthwise axis of the insulator extending at one end out of the insulator into a chamber formed by the inner wall of base 67 circumjacent the insulator. Axial member 69 is terminated in the chamber with an enlarged area which is tapered so as to form a tapered inner chamber with the inner periphery of the base. As in FIG. 3, the upper portion of member 69 is polarized magnetic south S, and the lower portion within the chamber magnetic north N. The inner periphery of base 67 is polarized magnetic south S and the outer periphery thereof magnetic north N. A magnetic field is created between base 67 and the tapered portion of member 69 in the vicinity of radial arcs 100, occurring between the inner periphery of base 67 and the outer periphery of tapered portion of member 69.

Figure 5:
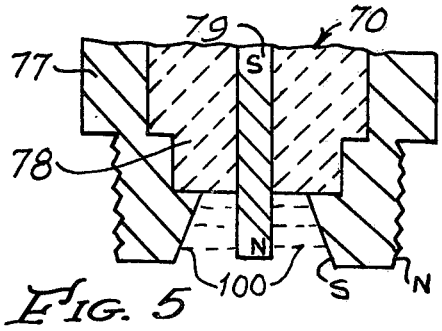
FIG. 5 is a cross-section view of a similar portion of an igniter as in FIG. 3 except that the inner periphery of the base is tapered.

Referring to FIG. 5, the lower or firing portion of igniter is shown at 70. Igniter 70 has a base 77 and insulator 78, similar to base 57 and insulator 58 of FIG. 4 respectively. Axial member 79 is provided through and along the lengthwise axis of the insulator extending at one end out of the insulator into a chamber formed by the inner wall of base 77 circumjacent the insulator. Axial member 79 is terminated in the chamber and magnetized with magnetic polarity north, N. Base 77 has its inner periphery tapered within the chamber so as to form a tapered inner chamber circumjacent the extended portion of member 79. The inner periphery of base 67 is polarized magnetic south S and the outer periphery thereof magnetic north N. A magnetic field is created between the tapered portion of base 77 and the magnetic north end of member 79 in the vicinity of radial arcs 100 occurring between the inner periphery of base 77 and outer periphery of member 79.

Figure 6:
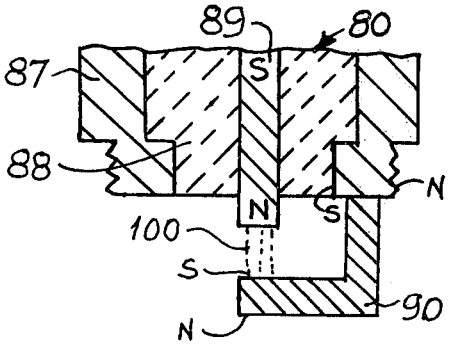
FIG. 6 is a cross-section view of a similar portion of an igniter as in FIG. 3 except that the base has an L-type extension member.

Referring to FIG. 6, the lower or firing portion of igniter is shown at 80. Igniter 80 has a base 87 and insulator 88. Axial member 89 is provided through and along the lengthwise axis of the insulator extending at one end out of the insulator. Such extended portion if polarized magnetic north N whereas the upper portion of member 89 is polarized magnetic south S. Base 87 has an L-shaped extension 90 integral therewith, a portion of such extension being opposite the extended north polarized end of member 89. The surface of extension 90 facing the north end of member 89 is polarized magnetic south S, the same as the inner periphery of base 87, and the portion opposite the polarized south face of the L-shaped extension is polarized magnetic north N, the same as the outer surface of base 87. A magnetic field is created between the south polarized face of extension 90 and the north polarized end of member 89 in the vicinity of the igniter electrodes or gap therebetween where an arc as at 100 occurs during firing of the igniter.

Figure 7:
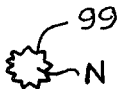
FIG. 7 is a plan view of an end of axial electrodes as in FIGS. 3–5 having jaggered peripheries.

Referring to FIG. 7, an end of an axial member as might be found at the north magnetic polarization of members 59, 69 or 79 of FIGS. 3-5, is provided with serations or jaggered periphery to encourage arcing between the jaggered points and the inner peripheries of the respective bases in the figures stated.

Figure 8:
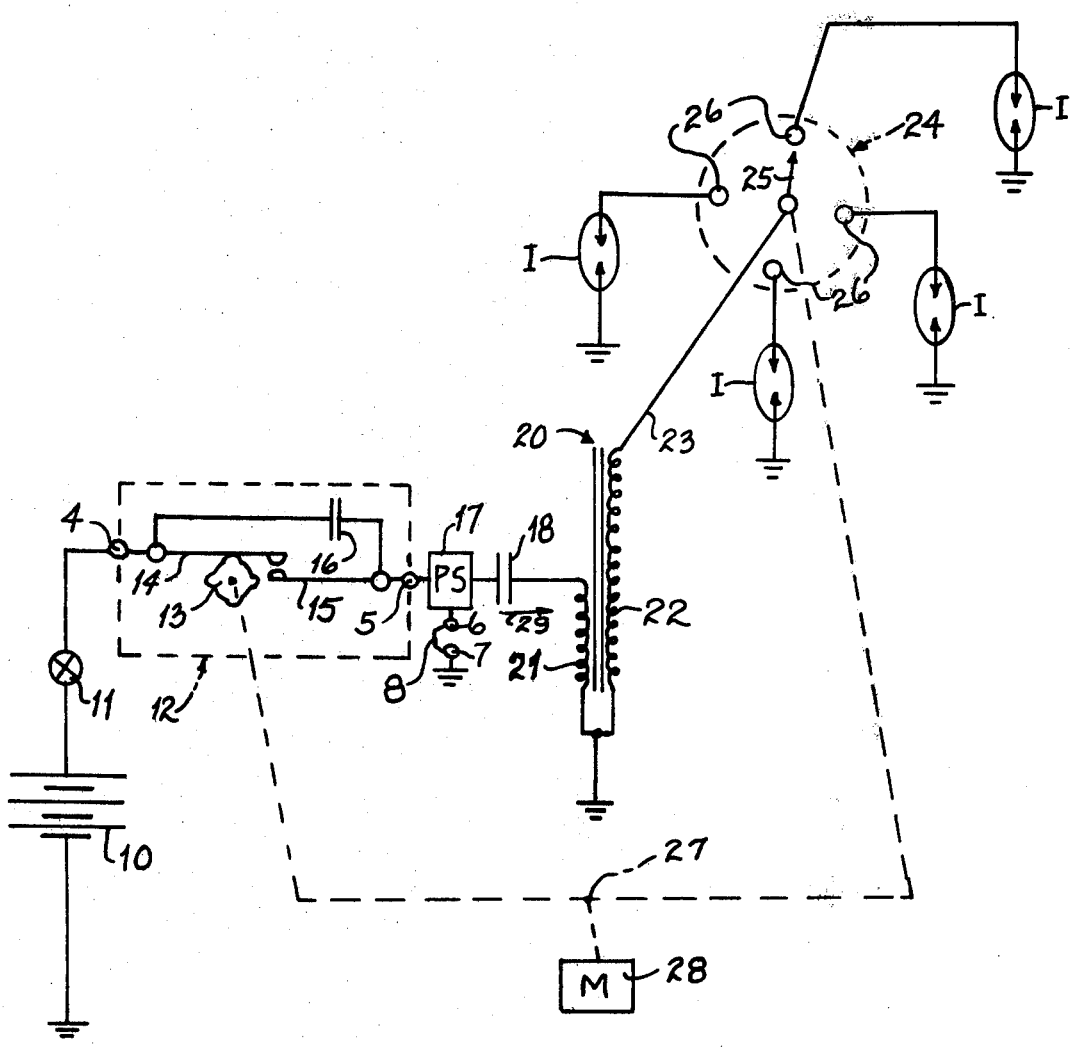
FIG. 8 is an electrical schematic showing a four-igniter system powered by a non-DC source, and energizing any of the igniters hereinabove mentioned.

Referring to FIG. 8 shown in schematic circuit form, and to FIGS. 9-14, any ignition system employing any of the igniters discussed in connection with FIGS. 1-7 and 9-14 may be utilized. The igniters are denoted in FIG. 8 as I. In the circuit of FIG. 8 the conventional ground symbol will act as an electrical return path for all components discussed therein.

Battery 10 providing a conventional 12-volt output is electrically connected to conventional timing device 12 through ignition switch 11. Timer 12 is operated on the principle of collapsing a magnetic field to provide energy transformation from primary to secondary of an ignition transformer fed through a high voltage distributor to igniters I.

Hence timer 12 has cam 13 with high and low portions, the number of high and low portions corresponding each to the number of igniters, for cooperation with breaker point 14 which is electrically connected to switch 11. Breaker point 15 is provided for connection to electronic power source (PS) 17. Capacitor 16 is connected across breaker points 14-15 to prevent pitting of points and for noise suppression. Hence when power has been supplied to power source 17 through closed breaker points at the time when cam 15 is at the non-cooperating phase with the breaker points, breaker points 14 and 15 are closed and current is supplied to non-DC power source 17. At times when distributor arm 25 of distributor 24 is opposite to stationary members 26 breaker points are opened collapsing the magnetic field in transformer 20 primary and interrupting current flow 29 in capacitor 18 and primary winding 21 of transformer 20, which current 29 is provided by rectangular wave output of power source 17. Such field collapse causes an induction of voltage into secondary 22 to deliver a high voltage by means of wire 23 to rotor 25 of distributor 24 at substantial current levels, as seen from tables below, to igniters I, so as to cause arcs 100 as hereinabove mentioned, to fire across igniter elements to ignite the fuel within the cylinders of the engine in sequence. The engine is represented by motor (M) at 28 drives by virtue of distributor shaft 27 both cam 13 and arm 25.

Motor (M) at 28 in a laboratory experiment discussed below to simulate firing of the ignition system, was an actual electric motor capable of developing 3000 revolutions per minute, equivalent to 6000 revolutions per minute of an engine (the distributor shaft is driven at one-half the engine speed).

With respect to power source 17, though this may be any AC source having a frequency or repetition rate to accommodate in excess of one cycle of excursion during the firing period (about 5 degrees) when arm 25 passes each of members 26, such source actually used was one having a rectangular wave output with a 2.5 kilohertz nominal repetition rate. Such repetition rate will accommodate the required number of excusions during the firing period of each igniter. It is also obvious that with a rectangular wave, the use of point assembly 12 or the like is not absolutely necessary, except for the fact that the voltages developed across secondary 22 were so high that without a timer such as 12, arcing starts way in advance of arm 25 arriving opposite member 26 and ceases way subsequent to departure of the arm from being in opposite position to member 26, called arc drag effect. The timer 12 shortens the undesired arc drag period. Setting the timer so that it switches current in the transformer when arm 25 is opposite members 26 is obviously the most desired setting to minimize arc drag. It is pointed out that with the frequency or repetition rate of source 17 being sufficiently high to permit several cycle excursions during period when arm 25 is opposite member 26, that instead of the field collapse method the timer could be set so that points 14-15 are closed during this period and opened when arm 25 is between members 26 to rapidly build up the the current in transformer primary, not possible with a Kettering type system utilizing a step function.

To make experimental measurements of voltages and currents in ignition transformer more easy to accomplish, terminals 14 and 15 had to be short circuited during such measurements when arm 25 was positioned opposite the stationary member 26 by manual rotation of shaft 27 with motor 28 not energized. This enabled power source 17 to supply rectangular wave current 29 through capacitor 18 and primary winding 21.

Because distributor shaft 27 is normally at ground potential, if it is desired to adapt the inventive system without modifications normally convenient only during fabrication of the engine, then the timer at 12 shown serially interconnected between terminals 4 and 5, used in the field collapse principle to fire the igniters, would have to be connected instead to terminals 6 and 7 with jumper wire 8 removed, and a short circuiting jumper wire connected between terminals 4 and 5. This floats the souce 17 intermittently with respect to ground, in accordance with switching-off mode of the contactors 14 and 15.

Power source 17, basically well known in the electronic art, consists of a pair of 2N3055 RCA transistors in conjunction with a coupling transformer providing feedback and output. Source 17 has a core with a rectangular hysterysis loop, generally of a nickel compound or ferrite dependent upon the switching frequency of the transistors desired, circuit 17 being a multivibrator circuit having a rectangular wave output with a 50% duty cycle. The advantage of a transformer coupled multivibrator circuit is that an output winding is available to enable coupling to igniter transformer 20 which also prevents DC components feeding the transistors from being applied to ignition transformer primary 21. Optionally, a multivibrator of resitive coupling could be used and capacitor 18 would inhibit DC components from flowing into primary 21.

However, the chief function for capacitor 18 is to provide an impedance match between output from power source 17 and transformer 20 when igniters I are firing. Such impedance match is obtained by placing a high power 1-ohm resistor in series between capacitor 18 and primary 21 with a voltmeter, responsive to the rectangular wave output of source 17, across the 1-ohm resistor and adjusting the value of the capacitor at 18 until a maximum current level 29 is obtained. In this instance the value of voltage read across the 1-ohm resistor will be the value of the current, by ohms law. In the application shown, the value of capacitor maximized at 4 microfarads.

Measurements were taken for voltages across primary 21, voltages across capacitor 18 and current 29. The values measured had to be peak to peak to be meaningful on account of the waveshape output of power source 17. Finally it is to be observed that no device is available to measure directly the high voltages of non-DC waveform across secondary 22 and therefore only an estimate thereof can be made under assumption that the efficiency of an ignition transformer is about 80% and that the turns ratio thereof is about 1000.

Measurements were taken for igniters consisting of FIGS. 3, 6 and 9–14, with electrode gaps or the length of radii A of the arc elements between 0.125 and 0.250 inches. A spoke-wheel of radial arcs or a series of arcs comprising a semi-elipsoid along the elipsoid major axis were observed. Slightly modified semi-elipsoid arc patterns are observable when the axial electrode is terminated in a disk or dish. A thick arc between electrode 89 and member 90 of FIG. 6 was exhibited.

One magnet was used during the measurements comprising a small magnet from a D'Arsonval meter movement made to fit about the base of the igniters to magnetize them as above stated. Alternately wire was wound about the base and connected to the 12 volt DC supply to similarly magnetize the base. Another magnet of the ceramic type of less than one-half inch diameter was attached to the axial electrode in the manner indicated to test the effect of magnetizing both the base and axial electrode. The difference in results indicated that magnetization of only either the base or axial electrode would suffice. The magnetization of igniter base and/or igniter axial member is given below in table (3).

To evaluate the significance of the measurements and results in terms of delivered energy to igniters, the following factual table of conditions is to be considered.

Table (1)

| Condition | Value |
|---|---|
| time of energy accumulation in transformer 20 for each igniter in an 8 cylinder engine driven at 6000 rpm | $1.67 \times 10^{-3}$ seconds |
| ignition transformer efficiency | 80% |
| duty cycle of rectangular wave output from power source 17 | 50% |

The parameters of table (1) have to be multiplied together to determine how much of the power developed in both the primary 21 and capacitor 18 is available per igniter, as a multiplying factor of the voltage-current products shown in table (2) for two different types of ignition transformers.

Based on calculations in application Ser. No. 707,208, the Kettering conventional system shows approximately $5 \times 10^{-3}$ watt-seconds delivered per each igniter in an eight cylinder engine computed at 6000 rpm. Similarly in a single ignition transformer system supplying non-DC power as here calculations showed about 9.6 watt-seconds and for a multi ignition transformer system, one transformer per igniter, the delivered energy calculations showed 12.9 watt-seconds. It is observed here that the calculations are more accurate than the measurements, simply because in the measurements only the peak-to-peak values could be taken as read by the voltmeter without considering the areas under the curves of several voltage and current waves observed on the oscilloscope. There is no way that meaningful RMS measurements can be made. However, notwithstanding this potential measurement error the observed results were quite close to the computations, with only about ⅔ of the values computed.

The voltage and current values (peak-to-peak) were taken under and during ignition firing conditions, as follows:

Table (2)

| | Delco-Remy 12 volt ignition transformer | | J.C.Whitney, Chicago, 12 volt ignition transformer, catalog number 155-1327P | |
|---|---|---|---|---|
| Condition | Igniter Not Magnetized | Igniter Magnetized | Igniter Not Magnetized | Ignit Igniter Magnetized |
| Volts across | 200 | 200 | 230 | 255 |

Table (2)-continued

| Condition | Delco-Remy 12 volt ignition transformer | | J.C.Whitney, Chicago, 12 volt ignition transformer, catalog number 155-1327P | |
|---|---|---|---|---|
| | Igniter Not Magnetized | Igniter Magnetized | Igniter Not Magnetized | Ignit Igniter Magnetized |
| primary 21 Volts across capacitor 18 | 120 | 120 | 170 | 190 |
| Amperes at 29 | 14 | 20 | 14 | 17 |
| Energy in Seconds, considering factors in table (1) | 2.99 | 4.28 | 3.74 | 5.05 |
| Ratio of Energy with respect to Kettering system | 598 | 856 | 748 | 1010 |
| Increase in Energy because of magnetization | | 43% | | 35% |

With a turns ratio of each ignition transformer of about 1000 and 80% efficiency, secondary voltages across winding 22 would from table (2) be in the range of 160,000 to 204,000 volts, which would be impossible to achieve utilizing a step function input into transformer 20 as in a Kettering type system.

In addition qualitative observations of the arc characteristics included the following when the arc was subjected to a magnetic field:

Table (3)

| Type of Observation | Results |
|---|---|
| arc discharge pitch or frequency | higher pitch or frequency with magnetic field, audibly noted |
| intensity of arc (brightness) | visibly increased with magnetic field |
| velocity of arc | apparent audible increase noted with magnetic field. |

Also noted, was the generation of ozone during firing of igniters in the air environment. It is therefore reasoned that since the fuel-air mixture injected into the engine is predominantly air, the air to fuel ratios being in the order of 14 parts air to 1 part fuel, with even higher ratios possible, that ozone would also be created in the engine during generation of the plasma arc and therefore increase materially the rate of fuel combustion. Ozone is represented as $O_3$ which means that it borrows an additional oxygen atom from the air, and since it is an extremely strong oxidizing agent, the increased combustion rate will further aid efficiency of performance. Such ozone generation is obtained by virtue of the high voltages of AC character with accompanied high electrical energies that are basically responsible for the plasma generation.

After the measurements, tests were made with motor 28 driving the distributor 24 and timer 12 to sequentially ignite all the four igniters. In this phase of experimentation, one smaller gap between electrodes of the igniter was set, as well as two gaps larger than 0.125 inches were provided. The largest gap or arc length radius A=0.250 inches, is shown in FIGS. 9–12. The igniters with A=0.250 inch gaps particularly exhibited semi-elipsoidal arc patterns at 100 and also emitted bright fireballs of light at points 101 where the arc struck the base under conditions of increased voltage from power source 17 applied to the primary of transformer 20 of magnitudes in voltages from 10 to 30 percent higher than shown in table (2). Also when driven by motor 28 the distributor switched energy to the several igniters connected thereto with different gap structure and gap openings. As the motor increased in speed, the arcs become brighter and at the highest speed instead of extinguishing as in a Kettering system, the arcs were of the brightest intensity. This indicates some sort of rate effect which cannot presently be explained, but nontheless a beneficial result since at the higher speeds faster and more intense impulses are desireable to fire igniters and properly combust the fuel in the engine. The larger gaps appeared to give more reliable performance than the small gaps.

Accordingly, the experimental results utilizing the circuit of FIG. 8, made use also of igniter configurations as shown in FIGS. 9–14.

With special reference to FIGS. 9–10, an igniter similar to igniter shown in FIGS. 1–2, is provided at 130 having a metallic magnetizable base 137 and an electrical insulator 138 secured to base 137. Axial electrode of magnetizable material 139 runs the length of insulator 138 and extends beyond the base and insulator with a magnetizable dish-shaped member as an integral part of axial electrode 139, the axial electrode assembly being held securely by the insulator. The dish-shaped member has apertures 140 therein for similar purposes as apertures 40 of FIGS. 1–2. Cap 143 is provided at the end of axial electrode opposite the base for making electrical connection to distributor member 26 of FIG. 8. As a result of firing this igniter, arc element group 100 is generated between the periphery of the dish and the firing end of the base, where arc length A, approximately synonymous with the distance between the dish periphery and the base periphery was in order of 0.250 inches, providing a ring of intense arcs shielded from the pressure gradient within the engine by virtue of the dish member being present integral with the igniter.

When voltage input into the igniter transformer was increased between 10 and 30 percent above the levels shown in table (2), the arc intensity increased, manifested by a thick arc terminating in a fireball of light as at 101 at the periphery of the base.

With specific reference to FIGS. 11–12, an igniter is provided at 230 comprising a modified form of igniter model J-12Y made by Champion Spark Plug Company. The igniter modification consisted of breaking off and filing down the residue of the L-extension to the base which normally provides a conventionally small gap with relation to the end of the axial electrode.

Base 237 comprising magnetizable material secures electrical insulator 238 through which axial electrode 239 comprising magnetizable material extends and is held by the insulator. Cap 243 of electrically conductive material is screwed to axial electrode end to make connection to ignition wire that interconnects the igniter with member 26 of the distributor as shown in FIG. 8.

A group of arcs at 100 may be best described as forming a somewhat distorted semi-elipsoidal pattern with respect to the major elipsoidal axis, wherein the skirt of the semi-elipsoid flares out somewhat away from the major axis toward the inner periphery of the base. Since the firing end of the axial electrode is raised substantially beyond and outside of the firing end of the base, the arc radii A=0.250 inches, so that each element of arc group 100 will be 0.250 inches in length. Although not illustrated in FIGS. 11–12, this configuration also makes a very strong and bright fireball of light similar to the one make in connection with FIGS. 9–10.

With specific reference to FIGS. 13–14, an igniter is provided at 330 comprising a modified form of igniter model 45S made by the AC Spark Plug Company. The model 45S igniter was modified by breaking off and filing off the residue of the L-extension to the base which usually provides the conventional small gap with relation to the firing end of the axial electrode.

Base 337 comprising magnetizable material secures electrical insulator 338 through which axial electrode 339 comprising magnetizable material extends and is held by the insulator. Cap 343 of electrically conductive material is secured to an end of the axial electrode to make connection to ignition wire that interconnects the igniter with member 26 of the distributor as shown in FIG. 8.

A group of arcs at 100 comprises a spoke-wheel configuration, since the axial electrode of this igniter is almost in the same plane as the firing end of the base. The arc lengths of radii A=0.125 inches, since the distance between the end of axial electrode and the inner periphery of the base is of such dimension.

Although only discussed for FIGS. 9–10, when the voltage input to the ignition transformer primary is increased between 10 and 30 percent, the fireball of bright white light will be present. Such fireballs should also be present under similar conditions in igniters of FIGS. 1–6.

The magnetizable material for igniters of FIGS. 9–14 as well as those of igniters in FIGS. 1–6 are all also electrically conductive.

With reference to FIGS. 15 and 16, an igniter at 430 comprises a modified model N-9Y Champion Spark Plug, from which over one-fourth of an inch in length of threaded seat or base 437 was sawed off at the base firing end to expose the generally cylindrical narrowed portion at such firing end of insulator 438 enveloping axial electrode 439. This makes available a gap between the exposed portion of axial electrode 439 and the terminal end of base 437 of approximately 0.500 inches, as shown at Z in FIG. 16. A washer 436 shown partialy cut away for details and preferably of magnetizable material was affixed by welding to electrode end at 439. The washer could have its faces permanently magnetized north N and south S as shown, or the magnetic polarities reversed. The diameter of washer 436 is about the same as the inner diameter of the base firing end for ease of insertion in the threaded portion of the engine block. Hence, with the use of washer 436, the pressure gradient or vector internal the engine, which gradient normally tends to extinguish arcs in the Y direction due to orientation of the igniter with relation to the vector, virtually in line therewith, such will not be the case with this igniter due to the shielding of the arcs between the outer washer periphery and the base periphery from such pressure gradient by virtue of such washer.

In the absence of washer 436, as in FIG. 16, the engine pressure vector will act upon the arcs in the relationship of arc horizontal and vertical components defined by equation:

$$X = Z \cos \Theta$$

where X is the horizontal component of the arc Z, Y is the vertical component of such arc, and Θ is the angle made by intersection of the plane of the firing end of base 437 with a plane defined by the direction of Z dimension. Thus the vertical component of the arc will be subject to pressure gradient forces while the horizontal component X will not be, in such configuration as in FIG. 16 without use of washer 436. But in FIG. 15 the series of arcs produced will be substantially vertical but shielded by washer 436 from action thereupon by the pressure gradient or vector. High voltage power distributed by the ignition distributor will be connected to cap 443 which is integral with axial electrode 439. A hexagonal collar at 455 which is part of base 437 is provided for enabling easy insertion of igniter into the engine.

Heavy and massive long arcs will be generated between the periphery of washer 436 and base 438 in almost a circular ring in FIG. 15, and in FIG. 16 configuration without the washer such massive arcs will form between the end of electrode 439 and base 438.

With reference to FIG. 17, means 440 is provided for enabling an alternate method of magnetization of igniters 1–7, 9–14 and 15–16. Such means consists of a body portion of magnetizable material made to adapt to cap 443 by a friction fit into aperture 444. A cylindrical member 445 similar to cap 443 diameter is used for making connection to the high voltage distributor. Means 440 is both electrically conductive and magnetizable so that north magnetic polarity N exists at face 446 and south magnetic polarity exists at face 447, or vice versa. The inner periphery 441 and outer periphery 442 of member 440 may optionally be magnetically polarized if desired. Though generally in a plasma igniter the magnetic field direction has been thought of as being orthogonal to the arc direction, it actually turns out that it makes no difference if it is orthogonal or parallel.

Member 440 may be made of such magnetizable materials as alnico or even hard steel, or ceramic providing an electrically conductive path is provided between portion 445 and wall surface 441.

In use, since the axial electrode portion with cap 443 is of magnetic material, the adaptation of member 440 to cap 443 will provide a magnetic flux through electrode 439 to obtain effects already discussed without any danger of demagnetization due to high engine temperatures, such member 440 being external the engine.

Another convenient manner of providing a magnetic field within the igniter is by adaptation of a ring 450 to base 437 as shown in FIG. 18. Such ring may merely fit over the larger diameter of insulator 438 in cooperation with portion of base 437 at the hex nut thereof opposite face portion 455. Ring 450 will thus have its aperture 454 circumjacent insulator 438. Ring 450 has magnetized surfaces such as 456 which has a north magnetic pole N and 457 which has a south magnetic pole S, causing attraction to the base. Optionally, the inner threaded periphery 451 and the outer periphery 452 may be magnetized N and S, or vice versa. Thus this ring may also be screwed on to the threads of base 437 where the base is of sufficient height. In either manner of adaptiation, the ring will provide the magnetic field to enhance the plasma action discussed above, and like member 440, will be external to the engine thus avoiding high engine temperatures and possible demagnetization. Ring 450 however, not having any function to conduct electrical power may be made of any magnetic material including material that is totally ceramic. Thus when ring 450 is screwed on to base 437, face 456 will abut face 455 of the base, or the magnetic polarity resulting can be reversed by having face 457 abut face 455.

Hence, it is obvious that member 440 and/or ring 450 can be made an integral part of the igniter. Magnetizing the axial electrodes and/or the base of any igniter would provide improved firing, probably even when excited by a Kettering type or modified Kettering type system. It follows that use of member 440 and/or ring 450 on an igniter in a Kettering type ignition system would improve ignition performance.

With reference to FIGS. 19–23, these figures are actual photographs taken at high camera speeds so as to substantially stop motion, shows several arc effects and phenomena of the plasma produced in the several arcs when igniters modified as discussed hereinbelow are used and powered by the non-DC power source. In all instances the igniters used originally had a bent over L-shaped portion attached to the base which was used to form a gap between the axial electrode and base L-shaped extension. This L-shaped portion was removed in all cases from the base.

In order to capture the various effects and phenomena, a motion picture camera Model Bolex Rex 5 loaded with high speed negative Kodak 7224, 16 millimeter film was used. The camera was set at 48 frames per second and to a shutter speed of 1/125 th seconds, so that each frame recorded events that occurred at approximately 167 microseconds. A close-up lens was used on the camera so that photographs were taken within several inches of the firing ends of the several igniters. Additionally ambient light was provided by an ordinary light bulb so that the fixtures in which the igniters were mounted as well as the igniter base would be visible in presence of the high intensity arc plasma produced. The results are sample frames selected to show variations in arc intensity and shapes.

With specific reference to FIG. 19, the igniter used was a long shank or base type made by Champion Spark Plug Company type N-13Y. When the L-shaped portion was removed therefrom, the distance between the base periphery and the axial electrode was about 0.125 inches=3.175 millimeters in view of the fact that the axial-electrode-base profile is raised so that arc elements tend to form in a cusp arc effect, wherein each arc element thereof was about 0.125 inches long, as may be seen in the four photographs at 501, 502, 503 and 504.

With specific reference to FIG. 20, the igniter used was an ordinary shank or base type made by Champion Spark Plug Company type J-12Y. When the L-shaped portion was removed therefrom, the distance between the base periphery and the axial electrode was about 0.250 inches=6.35 millimeters in view of the fact that the axial-electrode-base profile is raised so that the arc elements tend to form in a cusp arc effect, wherein each arc element thereof was about 0.250 inches=6.35 millimeters long, as may be seen in the four photographic frames at 511, 512, 513 and 514.

With specific reference to FIG. 21, the ingiter used was a long shank or base type made by Champion Spark Plug Company type N-9Y. When the L-shaped portion was removed therefrom, the end of the axial electrode was provided with a small plate or washer welded thereto so as to shield the arcs produced from the vertical pressure gradient within an operating engine. A sufficient portion of the shank was removed so as to provide a distance between the plate or washer and the base of about 0.500 inches=12.7 millimeters. Hence the arcs produces between the base and plate in the form of a tubular curtain arc effect had arc elements which were each 0.500 inches long. The several tubular arc effects captured are shown in the four photographic frames at 521, 522, 523 and 524.

With specific reference to FIG. 22, the igniter used was an ordinary shank or base type made by AC Spark Plug Company type 45S. When the L-shaped portion was removed therefrom, the distance between the base periphery and the axial electrode was about 0.125 inches=3.175 millimeters in view of the fact that the axial-electrode-base profile is low so that the arc elements form a spoke-wheel arc effect, wherein each arc element thereof was about 0.125 inches long, as may be seen from the four photographic frames at 531, 532, 533 and 534.

With specific reference to FIG. 23, modified Champion igniter type J-12Y was used to photograph the effects shown at 551 through 558, wherein igniter J-12Y had a distance between axial electrode and base of about 0.250 inches after modification by removal of the L-shaped portion from the base. Modified AC igniter type 45S was used to photograph the effects shown at 559 through 562. In the igniter at 559 and 560 only the L-shaped portion attached to the base was removed, whereas in the igniter at 561 and 562 a portion of the ceramic material surrounding the end of the axial electrode was also removed so as to enable firing within a chamber formed between the newly exposed portion of the axial electrode and the base. Thus the effective spacing between axial electrode and base for igniters 559 through 562 was about 0.125 inches. In this experiment, the results at 551 through 562 were obtained under conditions where the igniter firing voltage was increased between 10% and 30%, so as to yield as may be seen from the photographs, a light-bulb, fireball, or blooming illumination phenomena. It may be seen that the blooming illumination keeps increasing as progressing between 551 and 558 with increasing light intensity.

It is not known whether the order of effects occurring between 551 and 558 are in accordance with their sequence of numbers assigned, nor can we be certain that the events as shown in frames 559 through 562 would not occur somewhere in the sequence 551 through 558, since in frame 553 an outline of the round fireball apart from the arc terminating in a light-bulb or fireball is also visible.

However, in frames 559 and 560 some progression from an elongation arc to a ball-shaped fireball may be seen when first viewing frame 559 and then 560. A series of these fireballs were obtained photographically of which only the two at 559 and 560 are shown. This surprising phenomena is however enforced by viewing another series of such formed fireballs and arcs at 561 and 562 where the configuration of the igniter was changed as described above. Frames 561 and 562 are sequential frames selected from a film strip of like results thereon. Thus frames 561 and 562 clearly support the presence of the fireballs and their formation during the process of firing the igniters utilizing the non-DC power source to supply the energy thereto. Frames 561 and 562 show both the arcs terminating in fireballs and individual fireballs, with frame 562 showing two individual fireballs, one of them apparently being in transit between the axial electrode and base.

The experimental results and particularly the finding of ionized matter referred to as plasma and the ability to increase the plasma velocity and intensity by magnetic fields became of some concern and question as to whether radiation was present in dangerous dosages.

Therefore, the Bureau of Radiological Health of the Department of Health, County of Orange, State of California was called in to measure the plasma arcs. The above experiments were repeated before two representatives of said Bureau who directed a detector of radiation at a distance of between 1 and 2 inches from the plasma. The instrument used was Model 2592 Exposure Rate Meter made by Texas Nuclear Corporation, which had its own reference radiation calibration source of 56 milliroentgen per hour and the instrument was first calibrated before use using this calibration source. The result fortunately showed no radiation at all.

Radiation is generally of the $\alpha$, $\beta$ or $\gamma$ types. Radiation of $\alpha$ type is automatically ruled out since fissionable material was not involved; similarly for the $\beta$ type. Radiation of the $\gamma$ type includes X-rays and certain components within the X-ray band called "bremesstrahlung." It was the latter type that was most suspected, but the measurements by the Rate Meter showed that type to also be non-existant.

Hence, except for the explanation that plasma is a mass of charged particles and hence susceptible to magnetic fields, no other explanation appears to be logical for the exhibited increase in energy when exposing the plasma to a magnetic field.

Of interest might also be that the ozone generated was noted by the representatives of the Bureau of Radiological Health, and that medical confirmation of the effect of ozone upon the experimenter indicated headaches that persisted during experimentation period due to imbalance of oxygen intake compared with other gasses normally present in the atmosphere.

After conclusion of the experimentation, some 5 days elapsing, the headaches ceased.

Additionally, from the results obtained by magnetization of the axial electrode in terms of increased delivered energy, it becomes obvious that an ignition transformer may be constructed circumjacent the insulator of an igniter, such transformer being connected in the usual manner to a distributor wherein each igniter would have its own ignition transformer, and the electrical connections to the distributor would be made as in patent application Ser. No. 743,276 filed Nov. 19, 1976 and incorporated by reference herein for this purpose. The axial electrode of the igniter would act as the core of the transformer and magnetic flux would be produced in such core in alternation according with the power supplied by power source 17, thereby providing an alternating magnetic field that would act upon the arc to intensify same, similar to results obtained when a DC magnetic field was used, but with different orders of magnitude in the intensity obtained for the plasma.

I claim:

1. An igniter having an electrical insulator, comprising the combination of:

a magnetized base retaining said insulator, one end of said base being the firing end of said igniter; and a magnetized elongated electrode having a lateral protrusion integral therewith at said firing end, said electrode being retained by the insulator.

2. The invention as stated in claim 1, wherein said protrusion has apertures therein.

3. The invention as stated in claim 1, wherein said protrusion has tapered apertures therein.

4. The invention as stated in claim 1, wherein said protrusion has tapered apertures therein and wherein the smaller diameters of said tapered apertures are in closer proximity to the base than the larger diameters of said apertures.

5. The invention as stated in claim 1, wherein said protrusion is spaced from said base.

* * * * *

UNITED STATES PATENT OFFICE

CERTIFICATE OF CORRECTION

PATENT NO. : 4,161,937

DATED : July 24, 1979

INVENTOR(S) : Martin E. Gerry

It is certified that error appears in the above-identified patent and that said Letters Patent are hereby corrected as shown below:

Table (2) at columns 8 and 9, should read:

| Condition | Delco-Remy 12 volt ignition transformer | | J.C.Whitney, Chicago,12 vol ignition transformer, catalog number 155-1327F | |
|---|---|---|---|---|
| | Igniter Not Magnetized | Igniter Magnetized | Igniter Not Magnetized | Ignit Igniter Magnetized |
| Volts across primary 21 | 200 | 200 | 230 | 255 |
| Volts across capacitor 18 | 120 | 120 | 170 | 190 |
| Amperes at 29 | 14 | 20 | 14 | 17 |
| Energy in Watt-Seconds, considering factors in table (1) | 2.99 | 4.28 | 3.74 | 5.05 |
| Ratio of Energy with respect to Kettering system | 598 | 856 | 748 | 1010 |
| Increase in Energy because of magnetization | | 43% | | 35% |

UNITED STATES PATENT OFFICE

CERTIFICATE OF CORRECTION

PATENT NO. : 4,161,937

DATED : July 24, 1979

INVENTOR(S) : Martin E. Gerry

It is certified that error appears in the above-identified patent and that said Letters Patent are hereby corrected as shown below:

Column 7, line 51: change "voltage," to read - - voltage. - -

Signed and Sealed this

Sixteenth Day of October 1979

[SEAL]

Attest:

RUTH C. MASON
*Attesting Officer*

LUTRELLE F. PARKER
*Acting Commissioner of Patents and Tradema*